US007238011B2

(12) United States Patent
Ohtake

(10) Patent No.: US 7,238,011 B2
(45) Date of Patent: Jul. 3, 2007

(54) SCROLL COMPRESSOR

(75) Inventor: Shinichi Ohtake, Ohta (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 11/375,118

(22) Filed: Mar. 15, 2006

(65) Prior Publication Data

US 2006/0210415 A1 Sep. 21, 2006

(30) Foreign Application Priority Data

Mar. 16, 2005 (JP) ..... 2005-075417

(51) Int. Cl.
*F03C 2/00* (2006.01)
*F04C 18/00* (2006.01)

(52) U.S. Cl. ..... 418/55.2; 418/55.1; 418/55.4; 418/142

(58) Field of Classification Search ..... 418/55.1–55.6, 418/57, 91, 142, 178
See application file for complete search history.

(56) References Cited

U.S. PATENT DOCUMENTS 5,056,336 A * 10/1991 Harrison ..... 418/55.2
5,370,512 A * 12/1994 Fujitani et al. ..... 418/55.2
6,217,301 B1 * 4/2001 Kuroiwa et al. ..... 418/55.2
6,224,357 B1 * 5/2001 Komai et al. ..... 418/55.2
6,695,598 B2 * 2/2004 Fujita et al. ..... 418/55.2

FOREIGN PATENT DOCUMENTS

JP 10 9157 1/1998
JP 10 68392 3/1998

* cited by examiner

*Primary Examiner*—Theresa Trieu
(74) *Attorney, Agent, or Firm*—Baker Botts L.L.P.

(57) ABSTRACT

A scroll compressor has a fixed scroll including a fixed spiral wall and a movable scroll including a movable spiral wall. Inner end portions of the fixed and movable spiral walls each have an arc-like shape. The inner end portion of the fixed spiral wall has smaller width than the inner end portion of the movable spiral wall does.

6 Claims, 4 Drawing Sheets

SCROLL COMPRESSOR

BACKGROUND OF THE INVENTION

1. Field of the Invention

The present invention relates to a scroll compressor suitable for a refrigeration circuit included in a vehicle air conditioning system.

2. Description of the Related Art

The scroll compressor includes a fixed scroll and a movable scroll that makes a revolving movement with respect to the fixed scroll. The movable and fixed scrolls form a compression chamber in cooperation with each other. The revolving movement of the movable scroll continuously causes the process of sucking a refrigerant serving as working fluid into the compression chamber, the process of compressing the sucked refrigerant in the compression chamber, and the process of discharging the compressed refrigerant from the compression chamber. For this discharge process, the fixed scroll is provided with a discharge hole near the center thereof.

Specifically, the fixed and movable scrolls have their respective end plates and spiral walls protruding from the end plates. The discharge hole is formed in the end plate of the fixed scroll. The compression chamber is formed in between the fixed spiral wall of the fixed scroll and the movable spiral wall of the movable scroll.

The scroll compressor disclosed in Unexamined Japanese Patent Publication No. 10-9157 further includes tip seals mounted to the end faces of the fixed and movable spiral walls, and bottom sheets are laid on the inner faces of the end plates of the fixed and movable scrolls. The tip seal of the movable spiral wall slides against the bottom sheet of the fixed scroll, whereas the tip seal of the fixed spiral wall relatively slides against the bottom sheet of the movable scroll. These tip seals and bottom sheets increase the airtightness of the compression chamber, namely refrigerant compression efficiency.

Pressure in the compression chamber rises as the compression chamber moves toward the discharge hole, and is maximized at the terminal stage of the compression process. Therefore, the inner end portions of the fixed and movable spiral walls as viewed in the radial directions of the fixed and movable scrolls receive a high reactive force due to a compressed refrigerant at the terminal stage of the compression process. The inner end portions are therefore required to have enough strength to endure the compression reactive force.

For that reason, like the scroll compressor disclosed in Unexamined Japanese Patent Publication No. 10-68392, the arc-shaped inner end portions of the fixed and movable spiral walls are thicker than the other portions of the spiral walls, and have a stepped shape. More specifically, each of the inner end portions has a base portion located on the end plate side of the corresponding scroll and a top portion located on the bottom sheet side of the counterpart of the above scroll. The base portions have greater width than the top portions do.

In the case of the scroll compressor disclosed in the Publication, the inner end portions of the fixed and movable spiral walls have the same shape and size. Therefore, based on the boundary between the inner end portion of the fixed spiral wall and the other portions, that is, a seal-off point between an involute curving face forming the inner face of the other portions in the fixed spiral wall and the arc-shaped face forming the inner face of the inner end portion of the fixed spiral wall, the location of the discharge hole, the size of the bottom sheet of the fixed scroll and the location of an inner end portion of the movable tip seal mounted onto the movable spiral wall are primarily determined in this order.

The location of the inner end portion in the movable tip seal is an important factor that determines the refrigerant compression efficiency. Therefore, the compression efficiency of the scroll compressor disclosed in the Publication is automatically determined only by the seal-off point, which makes difficult further improvement of the compression efficiency.

SUMMARY OF THE INVENTION

An object of the present invention is to provide a scroll compressor capable of making further improvement of compression efficiency without changing a seal-off point.

In order to achieve the above object, a scroll compressor of the present invention comprises a fixed scroll including a fixed end plate, a fixed spiral wall protruding from the fixed end plate and having an inner end portion located at the center side thereof, and a discharge hole formed near the center of the fixed end plate so that a given clearance is secured in between the discharge hole and the inner end portion of the fixed spiral wall; a movable scroll mated with the fixed scroll, and including a movable end plate disposed to face the fixed end plate and a movable spiral wall protruding from the movable end plate toward the fixed end plate and engaging with the fixed spiral wall to form a compression chamber in cooperation with the fixed spiral wall, wherein the movable spiral wall has an inner end portion located at the center side of the movable end plate, and a terminal end of the inner end portion is bigger than a terminal end of the inner end portion of the fixed spiral wall; and a drive unit for driving the movable scroll to revolve with respect to the fixed scroll, the revolving movement of the movable scroll causing a series of processes including suction of working fluid into the compression chamber, compression of the sucked working fluid, and discharge of the compressed working fluid from the compression chamber through the discharge hole.

With the above-described scroll compressor, when the discharge process of working fluid is carried out, the terminal end of the inner end portion of the movable spiral wall revolves to move along an inner face of the inner end portion of the fixed spiral wall, whereas the terminal end of the inner end portion of the fixed spiral wall relatively moves along an inner face of the inner end portion of the movable spiral wall. As a result, the working fluid compressed in the compression chamber is discharged from the compression chamber through the discharge hole of the fixed scroll while the working fluid is pushed by the inner end portion of the movable spiral wall.

The terminal end of the inner end portion of the fixed spiral wall is smaller than the terminal end of the inner end portion of the movable spiral wall, and more specifically, the terminal end of the inner portion of the movable spiral wall has narrower width. Accordingly, compared to the inner face of the inner end portion of the movable spiral wall, the inner face of the inner end portion of the fixed spiral wall can be formed as a large, or deep, arc-shaped face.

Consequently, the location of the discharge hole to be disposed near the inner end portion of the fixed spiral wall can be displaced to the center side of the fixed scroll as much as the arc-shaped face forming the inner face of the inner end portion of the fixed spiral wall is formed deep, that is to say, as much as the inner face of the inner end portion is displaced to the center side of the fixed scroll. Such displacement of the discharge hole delays a completion time of the compression process, resulting in an improvement in working fluid compression efficiency.

More specifically, the fixed and movable spiral walls, except for the inner end portions thereof, further have outer and inner faces defined by involute curved surfaces, and seal-off points defining boundaries between the inner faces and the respective inner end portions. Each of the inner end portions of the fixed and movable spiral walls is formed to have an arc-like shape.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
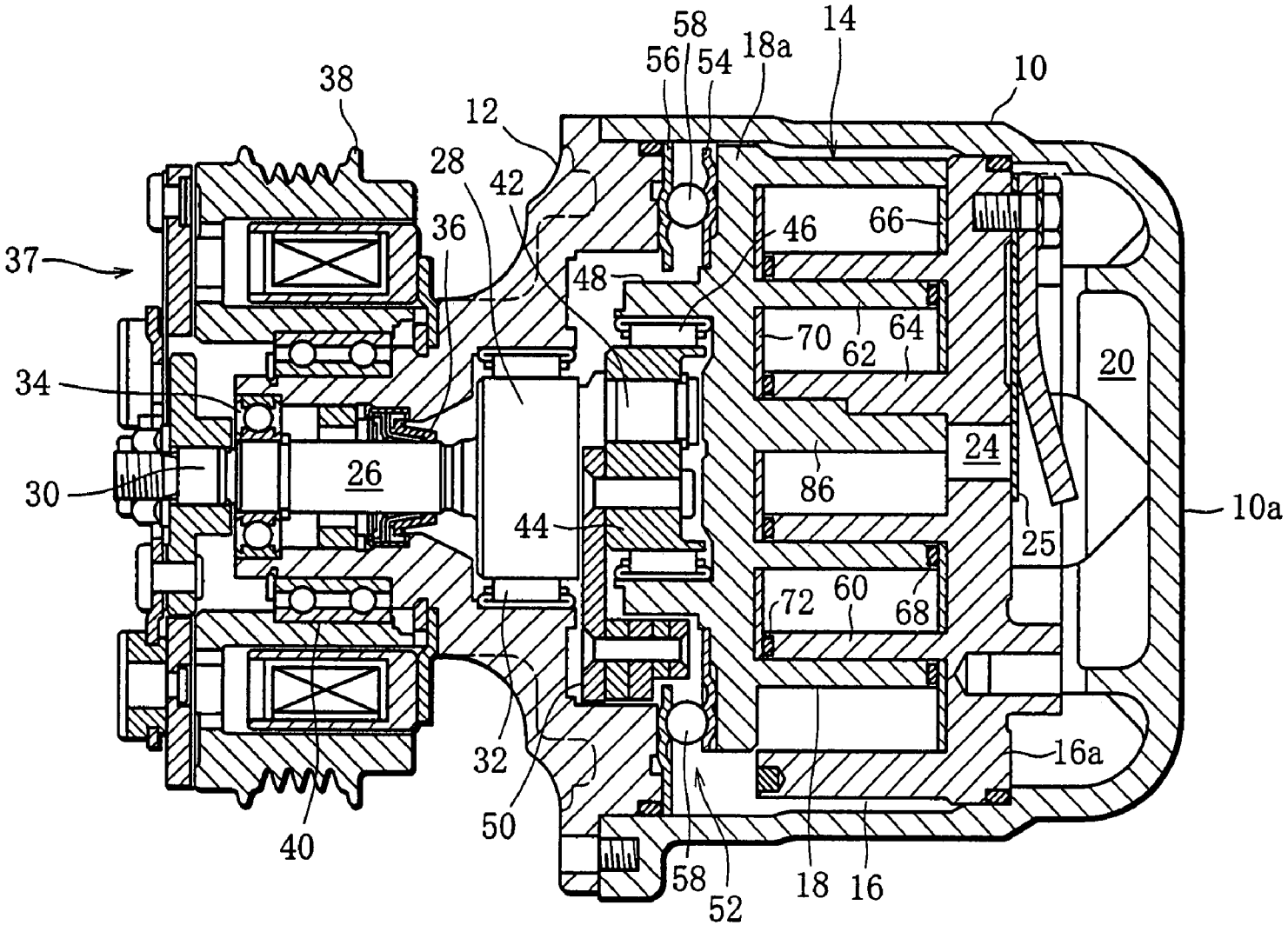
FIG. 1 is a sectional view showing a scroll compressor of an embodiment.

FIG. 1 shows a scroll compressor. The scroll compressor is disposed in a refrigeration circuit for a vehicle air conditioning system, compresses a refrigerant in the refrigeration circuit, and circulates the refrigerant through the refrigeration circuit.

The scroll compressor includes a rear casing 10 and a front casing 12. The casings 10 and 12 are joined to each other. A scroll unit 14 is accommodated in the rear casing 10. The scroll unit 14 has a fixed scroll 16 fixed to the rear casing 10 and a movable scroll 18 disposed to mate with the fixed scroll 16. As described below, the movable scroll 18 revolves with respect to the fixed scroll 16 in a state being prevented from rotating on the axis thereof. When the movable scroll 18 makes a revolving movement, the scroll unit 14 sequentially carries out the refrigerant suction process, the sucked refrigerant compression process, and the compressed refrigerant discharge process.

More specifically, the rear casing 10 has a discharge chamber 20 therein. The discharge chamber 20 is formed in between an end wall 10*a* of the rear casing 10 and the scroll unit 14, namely an end plate 16*a* of the fixed scroll 16. The end plate 16*a* includes a discharge hole 24 near the center thereof. The discharge hole 24 communicates with the discharge chamber 20. Disposed in the discharge chamber 20 is a discharge valve 25, which has a reed-like valve element, to thereby open/close the discharge hole 24. The rear casing 10 has a discharge port and a suction port of the refrigerant (neither discharge nor suction port is shown in FIG. 1). The discharge port communicates with the discharge chamber 20 and is connected to a refrigerant circulation path of the refrigeration circuit. The suction port is also connected to the refrigerant circulation path, to thereby allow the refrigerant to be introduced from the refrigerant circulation path into the rear casing 10. The introduced refrigerant is sucked from a suction inlet (not shown) of the scroll unit 14 into the scroll unit 14.

Arranged in the front casing 12 is a drive shaft 26. The drive shaft 26 has a large diameter end portion 28 and a small diameter shaft portion 30. The large diameter end portion 28 and the small diameter shaft portion 30 are rotatably supported to the front casing 12 by means of a needle bearing 32 and a ball bearing 34, respectively. The front casing 12 further includes a lip seal 36 surrounding the small diameter shaft portion 30. The lip seal 36 is located in between the bearings 32 and 34, and keeps the front casing 12 airtightly.

As is apparent from FIG. 1, the small diameter shaft portion 30 of the drive shaft 26 protrudes from the front casing 12. A protruding end of the small diameter shaft portion 30 is connected to a driving pulley 38 through an electromagnetic clutch 37. The driving pulley 38 is rotatably supported to the front casing 12 by means of a bearing 40. Extending from the driving pulley 38 is an endless driving belt (not shown). The driving belt is connected to an output pulley (not shown) of a vehicle engine. Therefore, during the driving of the engine, torque of the output pulley is transmitted to the driving pulley 38 through the driving belt. When the electromagnetic clutch 37 is in an ON state where the driving pulley 38 and the drive shaft 26 are interlocked with each other, the torque transmitted to the driving pulley 38 is further transmitted to the drive shaft 26 by the electromagnetic clutch 37. As a result, the drive shaft 26 rotates together with the driving pulley 38.

The large diameter end portion 28 of the drive shaft 26 has a crank pin 42, which protrudes from the large diameter end portion 28 toward the movable scroll 18 of the scroll unit 14. An eccentric bush 44 is mounted on the crank pin 42 and supports a boss 48 of the movable scroll 18 with the needle bearing 46 interposed therebetween. Accordingly, when the drive shaft 26 is rotated, the crank pin 42 and the eccentric bush 44 cause the movable scroll 18 to revolve with respect to the fixed scroll 16 around the axis of the drive shaft 26.

A coupling 52 is sandwiched between the front casing 12 and an end wall 18*a* of the movable scroll 18. The coupling 52 prevents from rotating of the movable scroll 18 on its axis. In the case of this embodiment, the coupling 52 includes a movable ring plate 54 and a fixed ring plate 56 which are arranged in the end wall 18*a* of the movable scroll 18 and a ring-shaped end wall of the front casing 12, respectively. The ring plates 54 and 56 each have a plurality of annular races. The annular races are arranged at regular intervals in a circumferential direction of the respective ring plates. The annular races of the ring plate 54 are opposed to the respective annular races of the ring plate 56, and balls 58 are hold between the respective opposed annular races. Therefore, when the balls move along the annular races during the revolving movement of the movable scroll 18, the rotation of the movable scroll 18 on its axis is prevented. Diameters of the annular races determine a revolving radius of the movable scroll 18.

The eccentric bush 44 is attached with a counter weight 50 for the movable scroll 18. The counter weight 50 enables a smooth revolving movement of the movable scroll 18.

Figure 2:
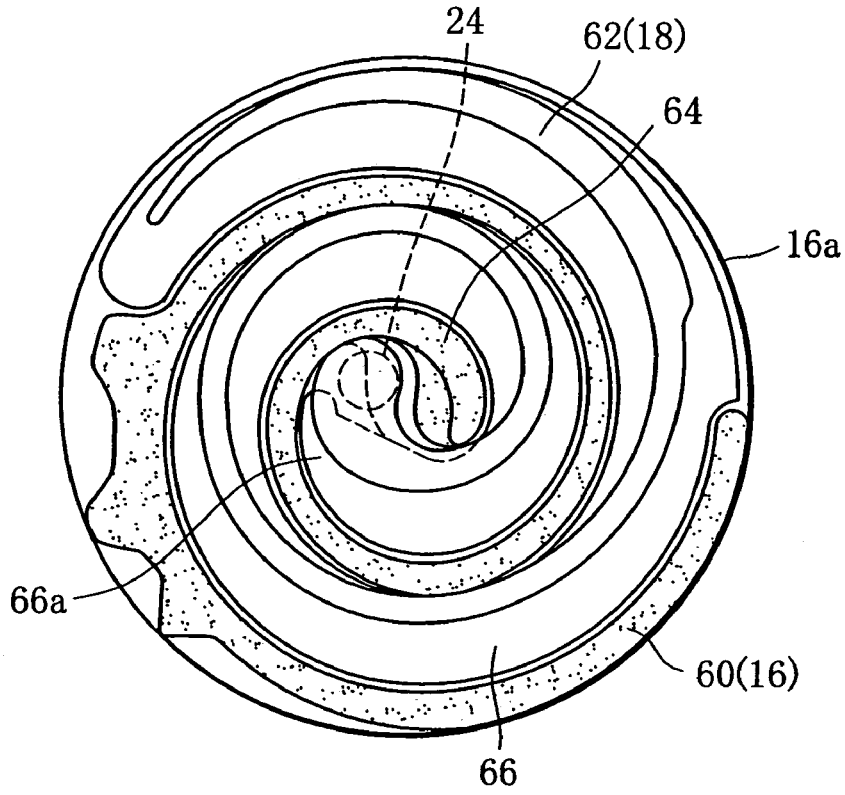
FIG. 2 is a view showing an engaging state of fixed and movable scrolls of the compressor of FIG. 1.

FIG. 2 more clearly shows an engaging state between the fixed scroll 16 and the movable scroll 18.

The fixed scroll 16 has a fixed spiral wall 60. The fixed spiral wall 60 is formed integrally with the end plate 16*a* of the fixed scroll 16, and protrudes from the end plate 16*a* toward the end plate 18*a* of the movable scroll 18. The movable scroll 18 had a movable spiral wall 62. The movable spiral wall 62 is formed integrally with the end plate 18*a* of the movable scroll 18, and protrudes from the end plate 18*a* toward the end plate 16*a* of the fixed scroll 16. In FIG. 2, in order to easy the distinction between the fixed spiral wall 60 and the movable spiral wall 62, the area indicating the fixed spiral wall 60 is provided with dot pattern.

Inner faces and outer faces of the fixed and movable spiral walls 60 and 62 are each formed of involute curved surfaces, except for arc-shaped inner end portions of the spiral walls 60 and 62 as viewed in a radial direction of the scroll unit 14. As is clear from FIG. 2, the discharge hole 24 is located near the inner end portion 64 of the fixed spiral wall 60, and there is secured a given clearance in between the discharge hole 24 and an inner face of the inner end portion 64.

When the movable scroll 18 is revolved, the fixed and movable spiral walls 60 and 62 form a compression chamber in cooperation with each other. The compression chamber is moved from the suction inlet toward the discharge hole 24 as the movable scroll 18 rotates. In this process, the volume of the compression chamber is gradually reduced.

Figure 3:
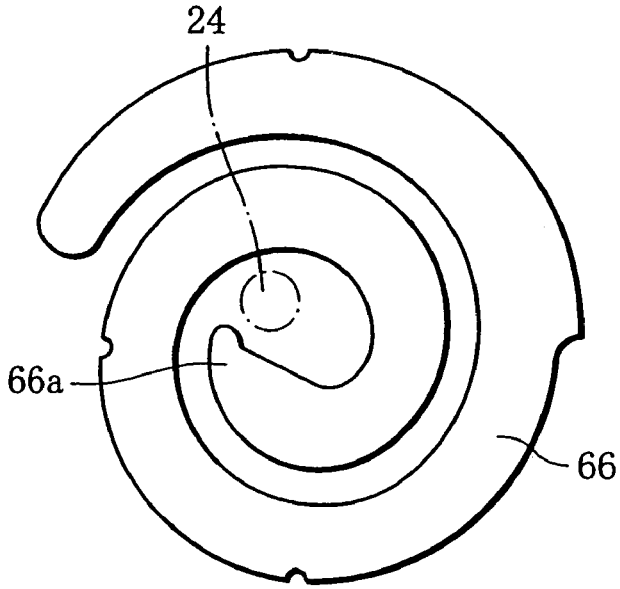
FIG. 3 is a plan view showing a bottom sheet of the fixed scroll of FIG. 2.

Disposed on an inner face of the end plate 16*a* of the fixed scroll 16 is a fixed bottom sheet 66. The fixed bottom sheet 66 is made of an abrasion-resist material and has a spiral shape as is obvious from FIG. 3. Therefore, the fixed bottom sheet 66 extends along the fixed spiral wall 60 so as to cover a spiral-shaped region formed in between the turns of the fixed spiral wall 60 on the inner face of the end plate 16*a*.

The movable spiral wall 62 has an end face opposed to the end plate 16*a*, and a movable tip seal 68 is attached onto the end face thereof. The movable tip seal 68 has a similar spiral shape to the shape of the movable spiral wall 62, and extends along the movable spiral wall 62. Although the movable tip seal 68 is not shown in FIG. 2, it is illustrated in FIG. 1.

The movable tip seal 68 contacts the fixed bottom sheet 66, and slides against the fixed bottom sheet 66 when the movable scroll 18 makes the revolving movement. Therefore, the fixed bottom sheet 66 has enough size to cover the revolving movement of the movable tip seal 68. As is apparent from FIG. 3, the fixed bottom sheet 66 always opens the discharge hole 24, and there is secured a given clearance in between an inner end portion 66*a* of the fixed bottom sheet 66 and the discharge hole 24.

The movable scroll 18 has a movable bottom sheet 70 (see FIG. 1) similar to the fixed bottom sheet 66. The fixed spiral wall 60 is provided in the end face thereof with a spiral-shaped fixed tip seal 72 (see FIG. 1) that operates in cooperation with the movable bottom sheet 70. During the revolving movement of the movable scroll 18, the fixed tip seal 72 relatively slides against the movable bottom sheet 70.

Figure 4:
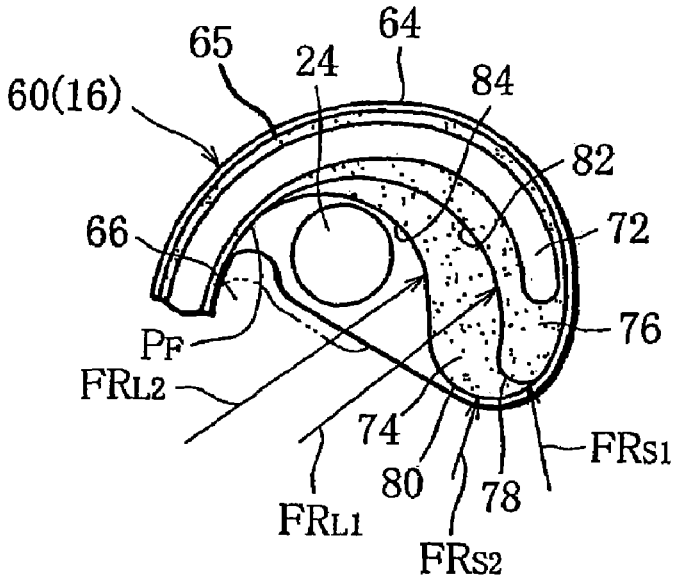
FIG. 4 is a detail view showing an inner end portion of a fixed spiral wall of the fixed scroll of FIG. 2.

FIG. 4 shows in detail the arc-shaped inner end portion 64 of the fixed spiral wall 60.

The inner end portion 64 has an outer face 65 and a stepped shape as viewed in the axial direction of the scroll unit 14. In other words, the inner end portion 64 includes a base portion 74 located on the end plate 16*a* side of the fixed scroll 16 and a top portion 76 located on the fixed tip seal 72 side. The base portion 74 bulges out to the inner side of the top portion 76 as viewed in the radial direction of the fixed spiral wall 60, thereby having a greater width tan the top portion 76. The inner end portion 74 in the stepped shape has sufficient strength against the compression reactive force of the refrigerant, and significantly contributes to the weight saving of the fixed scroll 16.

More specifically, an end of the top portion 76 has an arc-shaped terminal face 78, and an end of the base portion 74 has an arc-shaped terminal face 80. The arc-shaped terminal faces 78 and 80 have curvature radiuses $FR_{S1}$ and $FR_{S2}$, respectively. The curvature radius $FR_{S1}$ is smaller than the curvature radius $FR_{S2}$.

An inner face of the top portion 76 is formed as an arc-shaped inner face 82, and an inner face of the base portion 74 as an arc-shaped inner face 84. The arc-shaped inner face 82 extends from a starting point of the involute curved face forming the inner face of the fixed spiral wall 60, that is, a seal-off point $P_F$, toward the arc-shaped terminal face 78 and is directly or indirectly connected to the arc-shaped terminal face 78. The arc-shaped inner face 84 also extends from the seal-off point $P_F$ toward the arc-shaped terminal face 80 and is directly or indirectly connected to the arc-shaped terminal face 80. As illustrated in FIG. 4, the arc-shaped inner faces 82 and 84 have curvature radiuses $FR_{L1}$ and $FR_{L2}$, respectively. The curvature radius $FR_{L1}$ is larger than the curvature radius $FR_{L2}$.

The inner end portion 64 illustrated in FIG. 4 has a configuration in which the arc-shaped inner faces 82 and 84 are directly connected to the arc-shaped terminal faces 78 and 80, respectively. In actuality, however, the arc-shaped inner faces 82 and 84 are smoothly connected to the arc-shaped terminal faces 78 and 80 through flat faces.

Figure 5:
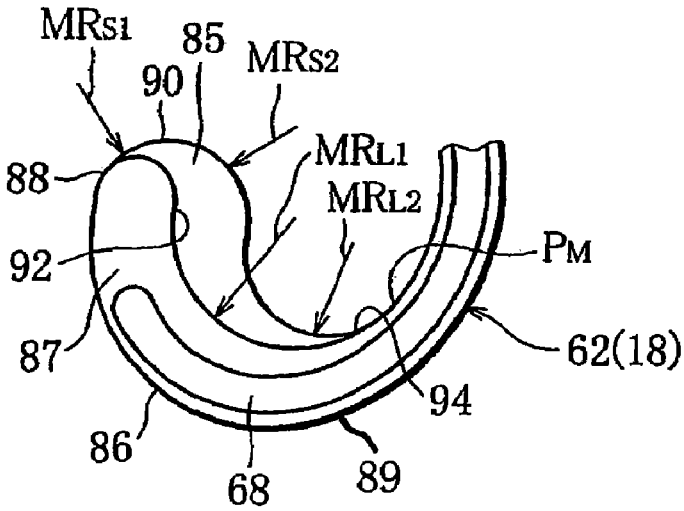
FIG. 5 is a detail view showing an inner end portion of a movable spiral wall of the movable scroll of FIG. 2.

FIG. 5 is a detail view of the arc-shaped inner end portion 86 of the movable spiral wall 62, as viewed from the movable tip seal 68 side.

The inner end portion 86 also has an outer face 89 and a stepped shape similar to the shape of the inner end portion 64 and includes a base portion 85 and a top portion 87. The inner end portion 86 contributes to the weight saving of the movable scroll 18 and has sufficient strength against the compression reactive force of the refrigerant.

An end of the top portion 87 has an arc-shaped terminal face 88, and an end of the base portion 85 has an arc-shaped terminal face 90. An inner face of the top portion 88 is formed as an arc-shaped inner face 92, and an inner face of the base portion 85 as an arc-shaped inner face 94. The arc-shaped inner face 92 extends from a seal-off point $P_M$ (starting point of the involute curved surface) of the inner face of the movable spiral wall 62 toward the arc-shaped terminal face 88, and is connected to the arc-shaped terminal face 88 directly or with a flat face interposed therebetween. The arc-shaped inner face 94 also extends from the seal-off point $P_M$ toward the arc-shaped terminal face 90, and is connected to the arc-shaped terminal face 90 directly or with a flat face interposed therebetween. As illustrated in FIG. 5, the arc-shaped terminal faces 88 and 90 have curvature radiuses $MR_{S1}$ and $MR_{S2}$, respectively. The arc-shaped inner faces 92 and 94 have curvature radiuses $MR_{L1}$ and $MR_{L2}$, respectively.

The curvature radiuses FR and MR have the following relationship in order to allow the revolving movement of the movable spiral wall 62.

$$FR_{S1}+SR+C=MR_{L2} \quad (1)$$

$$FR_{S2}+SR+C=MR_{L1} \quad (2)$$

$$MR_{S1}+SR+C=FR_{L2} \quad (3)$$

$$MR_{S2}+SR+C=FR_{L1} \quad (4)$$

SR and C in formulae (1) to (4) represent the revolving radius of the movable spiral wall 62 and a clearance between the inner end portions 64 and 86, respectively.

In this embodiment, the following relationship is established between the curvature radiuses FR and MR.

$$FR_{S1}<MR_{S1},\ FR_{S2}<MR_{S2} \quad (5)$$

Formula (5) means that the terminal end of the inner end portion 86 of the movable spiral wall 62 is bigger than the terminal end of the inner end portion 64 of the fixed spiral wall 60. In other words, the terminal end of the inner end portion 64 is smaller than the terminal end of the inner end portion 86, or has smaller width than the terminal end of the inner end portion 86 does.

On the condition that there is no change in the seal-off points $P_F$ and $P_M$ of the fixed and movable spiral walls 60 and 62, distance between the seal-off point $P_F$ of the fixed spiral wall 60 and the terminal end of the inner end portion 64 is longer than distance between the seal-off point $P_M$ of the movable spiral wall 62 and the terminal end of the inner end portion 86, resulting in the following relationship.

$$FR_{L1}>MR_{L1},\ FR_{L2}>MR_{L2} \quad (6)$$

As is clear from Formula (6), the arc-shaped inner face 84 of the base portion 74 of the inner end portion 64 has a greater curvature radius than the arc-shaped inner face 94 of the base portion 85 of the inner end portion 86 ($FR_{L2}>MR_{L2}$). Therefore, compared to the case where the arc-shaped inner faces 84 and 94 have identical curvature radiuses, the arc-shaped inner face 84 is caved outward in the radial direction of the corresponding spiral wall 60 to a greater degree than the arc-shaped inner face 94. Accordingly, when the condition that a given clearance is secured in between the arc-shaped inner face 84 and the discharge hole 24 is satisfied, the discharge hole 24 is displaced from a normal position shown by a chain double-dashed line in FIG. 6 to a position shown by a solid line toward the center of the fixed spiral wall 60.

Figure 6:
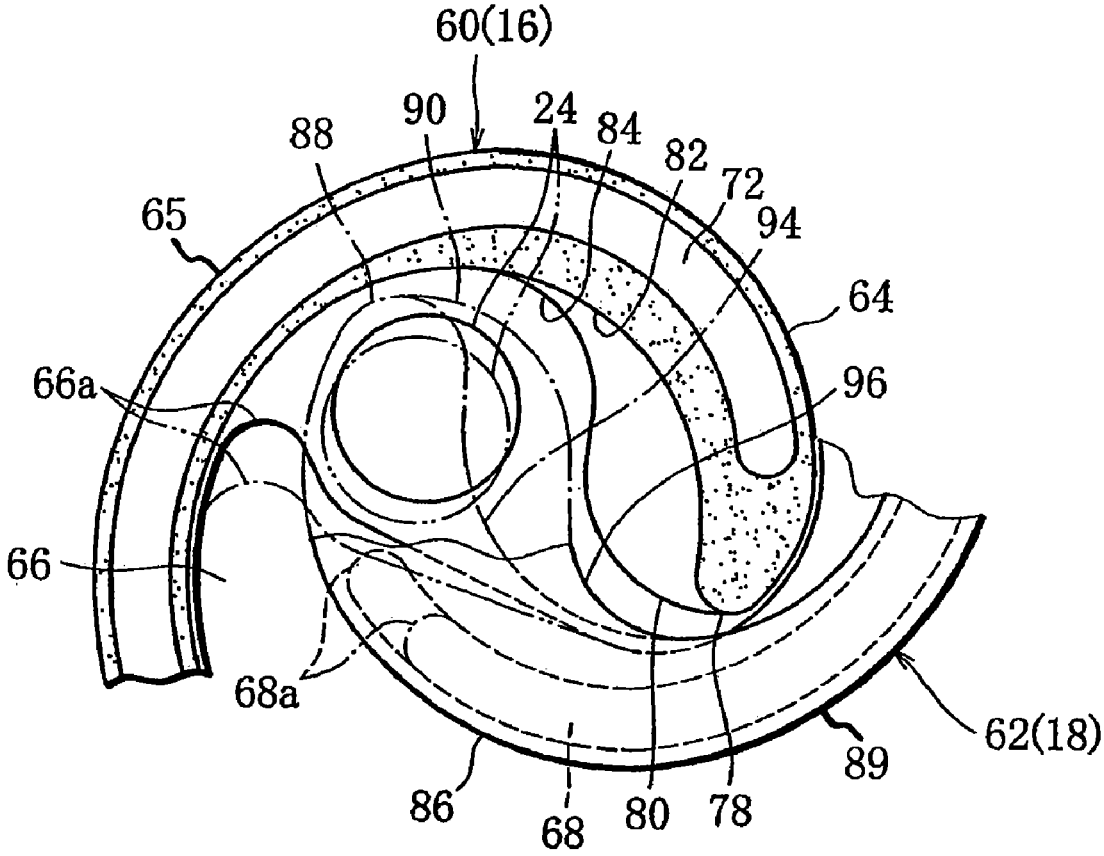
FIG. 6 is a view for explaining advantages achieved by the present invention.

Such displacement of the discharge hole 24 makes it possible to extend the inner end portion 66*a* of the fixed bottom sheet 66 from a normal position shown by a chain double-dashed line to a position shown by a solid line toward the discharge hole 24 in FIG. 6. Consequently, a terminal end 68*a* of the movable tip seal 68 of the movable spiral wall 62 can also be extend from a normal position shown by a chain double-dashed line to a position shown by a broken line in FIG. 6 as much as the inner end portion 66*a* of the fixed bottom sheet 66 is elongated toward the center of the fixed spiral wall 60. More specifically, the movable tip seal 68 is elongated as far as the terminal end 68*a* of the movable tip seal 68 does not come off from the fixed bottom sheet 66 during the revolving movement of the movable scroll 18.

As a consequence, a termination time of the refrigerant compression process is delayed as much as the terminal end 68*a* of the movable tip seal 68 extends toward the center of the movable spiral 62, which further improves the refrigerant compression efficiency.

The present invention is not limited to the above-described one embodiment, and various modifications can be made.

For example, the inner end portions 64 and 86 of the fixed and movable spiral walls 60 and 62 do not have to have the stepped shape. Furthermore, a coupling or valve of another type may be utilized instead of the coupling 52 and the discharge valve 25.

What is claimed is:

1. A scroll compressor comprising:

a fixed scroll including a fixed end plate, a fixed spiral wall protruding from the fixed end plate, and a discharge hole formed near the center of the fixed end plate, wherein the fixed spiral wall comprises an inner face, an outer face, and an inner end portion located at a center side of the fixed end plate, the inner end portion including a terminal end having an arc-shaped terminal face connecting the inner face and the outer face, the discharge hole located so that a given clearance is secured in between the discharge hole and the inner end portion of the fixed spiral wall;

a movable scroll mated with said fixed scroll, said movable scroll including a movable end plate disposed to face the fixed end plate and a movable spiral wall protruding from the movable end plate toward the fixed end plate and engaging with the fixed spiral wall to form a compression chamber in cooperation with the fixed spiral wall, wherein the movable spiral wall comprises an inner face, an outer face, and an inner end portion located at a center side of the movable end plate, the inner end portion having a terminal end with a terminal face, the terminal end of the inner end portion of the movable spiral wall being bigger than the terminal end of the inner end portion of the fixed spiral wall;

a drive unit for driving said movable scroll to revolve with respect to said fixed scroll, the revolving movement of said movable scroll causing a series of processes including suction of working fluid into the compression chamber, compression of the sucked working fluid, and discharge of the compressed working fluid from the compression chamber through the discharge hole; and wherein a curvature radius of the terminal face of the fixed spiral wall is smaller than a curvature radius of the terminal face of the movable spiral wall, a curvature radius of the inner face of the fixed spiral wall is greater than a curvature radius of the inner face of the movable spiral wall, and curvature radiuses of the inner faces of the fixed and movable spiral walls are greater than curvature radiuses of the terminal faces of the fixed and movable spiral walls.

2. The scroll compressor according to claim 1, wherein:

the terminal end of said inner end portion of the fixed spiral wall has a narrower width than the terminal end of the inner end portion of the movable spiral wall.

3. The scroll compressor according to claim 1, wherein:

the outer and inner faces of the fixed and movable spiral walls, except for the inner end portions thereof, are defined by involute curved surfaces, and adapted to form seal-off points defining boundaries between the inner faces and the respective inner end portions; and the inner end portions of the fixed and movable spiral walls are arc-shaped.

4. The scroll compressor according to claim 1, wherein: the inner end portions of the fixed and movable spiral walls each have a stepped shape so as to engage with each other.

5. The scroll compressor according to claim 4, wherein: each of the inner end portions of the fixed and movable spiral walls includes a base portion located on the end plate side of the corresponding spiral wall and having an arc-shaped terminal face and an arc-shaped inner face, and a top portion located on the end plate side of the counterpart spiral wall, having narrower width than the base portion, and having an arc-shaped terminal face and an arc-shaped inner face.

6. The scroll compressor according to claim 1, wherein: said fixed scroll further includes a spiral-shaped bottom sheet disposed on the end plate, avoiding said discharge hole, the bottom sheet extending along the fixed spiral wall; and said movable scroll further includes a spiral tip seal attached onto an end face of the movable spiral wall, which is opposed to the bottom sheet, along the movable spiral wall, the tip seal sliding against the bottom sheet during the revolving movement of said movable scroll.

* * * * *